United States Patent [19]

Schlosser

[11] Patent Number: 4,749,832

[45] Date of Patent: Jun. 7, 1988

[54] ILLUMINATED PUSH BUTTON SWITCH MODULE

[75] Inventor: Mark S. Schlosser, Seattle, Wash.

[73] Assignee: Bell Industries, Inc., Redmond, Wash.

[21] Appl. No.: 914,816

[22] Filed: Oct. 3, 1986

Related U.S. Application Data

[63] Continuation of Ser. No. 733,718, May 13, 1985, abandoned.

[51] Int. Cl.[4] ..... H01H 9/00

[52] U.S. Cl. ..... 200/314; 200/303

[58] Field of Search ..... 200/314, 313, 310, 307, 200/317, 303, 330, 331, 295

[56] References Cited

U.S. PATENT DOCUMENTS

| | | | |
|---|---|---|---|
| 2,962,572 | 11/1960 | Duffield | 200/303 |
| 3,267,245 | 8/1966 | Vincent | 200/314 |
| 3,467,802 | 9/1969 | Martin | 200/314 |
| 3,508,043 | 4/1970 | Dellert | 200/317 |
| 3,515,835 | 6/1970 | Debras | 200/314 |
| 3,517,148 | 6/1970 | Dipilla | 200/314 |
| 3,522,402 | 8/1970 | Dipilla | 200/314 |
| 3,988,557 | 10/1976 | Francke et al. | 200/314 |

*Primary Examiner*—Henry J. Recla
*Assistant Examiner*—Linda J. Sholl
*Attorney, Agent, or Firm*—Freilich, Hornbaker, Rosen & Fernandez

[57] ABSTRACT

An illuminated push button switch module comprised of a lamp subassembly and push button switch subassembly. The switch subassembly is physically mounted on and electrically connected to a circuit board. The lamp subassembly is configured for detachable spring mounting on the switch subassembly enabling the lamp subassembly to be manually depressed to actuate the switch subassembly. The spring mounting includes a pair of coil springs which terminate in cantilevered arms to electrically contact pads on the lamp subassembly for energizing an incandescent bulb carried thereby. The lamp subassembly can be easily detached from the switch subassembly for bulb replacement.

11 Claims, 8 Drawing Sheets

ILLUMINATED PUSH BUTTON SWITCH MODULE

This is a continuation of co-pending application Ser. No. 733,718 filed on May 13, 1985 now abandoned.

FIELD OF THE INVENTION

This invention relates to an illuminated push button switch module intended to be actuated by finger pressure and particularly suited for use in integrated panel displays of the type widely employed in aircraft, marine, and various industrial applications.

BACKGROUND OF THE INVENTION

Integrated display panels are used in a myriad of applications for controlling diverse electrical functions. Such panels typically consist of a rear printed circuit board having a plurality of push button switches mounted thereon and a front apertured plate overlaying the circuit board. Typically, a lamp, e.g. incandescent bulb, is mounted on the circuit board adjacent each switch for illuminating a translucent chip positioned in an aperture in the front plate.

SUMMARY OF THE INVENTION

The present invention is directed to a small illuminated push button switch module which can be readily mounted on a printed circuit board and subsequently easily removed for replacement or repair.

In accordance with a preferred embodiment, the switch module is comprised of a switch subassembly and a lamp subassembly. The switch subassembly is configured with multiple female connectors adapted to be physically mounted on and electrically connected to conductive pins secured to the circuit board.

In accordance with a significant feature of the invention, the lamp subassembly is configured for detachable spring mounting on the switch subassembly. The spring mounting enables a user to apply finger pressure to the lamp subassembly to in turn actuate the switch subassembly.

In accordance with a further feature of the preferred embodiment, the perimeter of the lamp subassembly is smaller than the perimeter, in a parallel plane, of the switch subassembly, thereby enabling an apertured front plate to be secured parallel to the circuit board to sandwich the switch subassembly therebetween while also allowing the lamp subassembly to project forwardly through an aperture in the front plate.

In accordance with a still further feature, each lamp subassembly has an incandescent bulb mounted therein electrically connected to a pair of contact pads which automatically mate with a pair of spring contacts when the lamp subassembly is properly mounted on the switch subassembly.

In accordance with a further feature of the preferred embodiment, each spring contact is formed on the end of a substantially rigid arm cantilevered from an end coil of a coil spring. The rigid arm provides a predictable reaction force to the depression of the lamp subassembly and assures a good low resistance nonsliding contact between each spring contact and its mating contact pad.

In accordance with a still further feature, each lamp subassembly is mounted so that a user can, from the front side of the apertured plate and using only his hands, detach the lamp subassembly from its switch subassembly in order to relamp the switch module.

U.S. Patent Applications Ser. No. 733,709 now U.S. Pat. No. 4,656,323 and 733,698, now U.S. Pat. No. 4,635,167 filed concurrently herewith, are respectively directed to the push button electric switch subassembly and low profile lamp subassembly incorporated in the switch module herein. The drawings and related technical description describing an exemplary embodiment are substantially identical in all three applications.

DETAILED DESCRIPTION OF EXEMPLARY EMBODIMENT

Figure 1A:
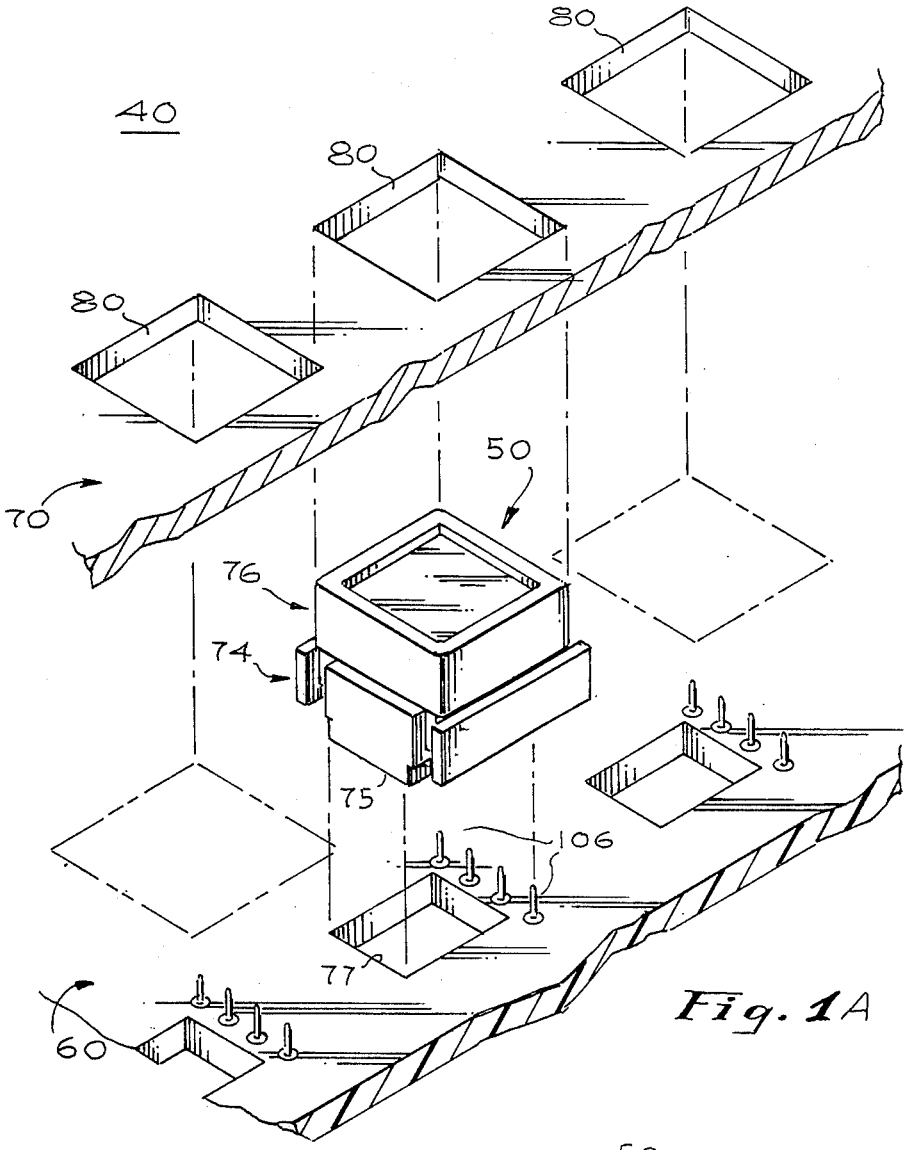
FIG. 1A is an exploded isometric view of a portion of an integrated display panel and FIG. 1B is a schematic sectional view, both showing a preferred switch module embodiment and its relationship to a circuit board and an apertured front plate.

Attention is initially directed to FIG. 1A which illustrates a portion of an integrated display panel 40 incorporating one or more illuminated push button switch modules 50 in accordance with the invention. The display panel 40 further includes a rear printed circuit board 60 and an apertured front plate 70.

Briefly, the switch module 50 is comprised of a switch subassembly 74 and a lamp subassembly 76. Prior to discussing the constructional details of the switch and lamp subassemblies 74, 76, it would be helpful to first understand how these subassemblies relate to one another when incorporated in the display panel 40. Initially, it should be noted that the switch subassembly 74 is essentially planar in shape and is mounted parallel to the front or upper surface 78 of the circuit board 60 with a depending portion 75 of the subassembly 74 fitting closely in an opening 77 in the board 60. The lamp subassembly 76 is also essentially planar in shape and is spring mounted on the switch subassembly 74 for limited reciprocal displacement (arrow 79, FIG. 1B), essentially toward and away from the switch subassembly 74. A user, by applying downward finger pressure on the lamp subassembly 76 actuates the switch subassembly in a manner to be described hereinafter. The lamp subassembly 76 additionally functions as an illuminated indicator for the switch module 50 and can be readily detached from the switch subassembly 74 for relamping.

Figure 1B:
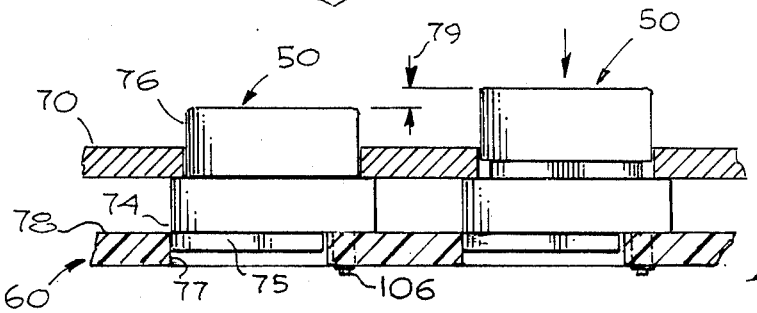

FIG. 1B illustrates two switch modules 50, the module on the right being depicted in its quiescent position and the module on left in its actuated position. It is to be noted in FIG. 1B that the switch subassembly 74 has a larger perimeter than the lamp subassembly 76 so that the apertured front plate 70 can bear against the switch subassembly 74 while enabling the lamp subassembly 76 to pass through an aperture 80 in the plate 70. The rear face 82 of the plate 70 around the aperture 80 engages the upper edge surface of the switch subassembly 74 enabling the plate 70 to clamp the switch assembly 74 against the front surface 78 of the circuit board 60.

Figure 2:
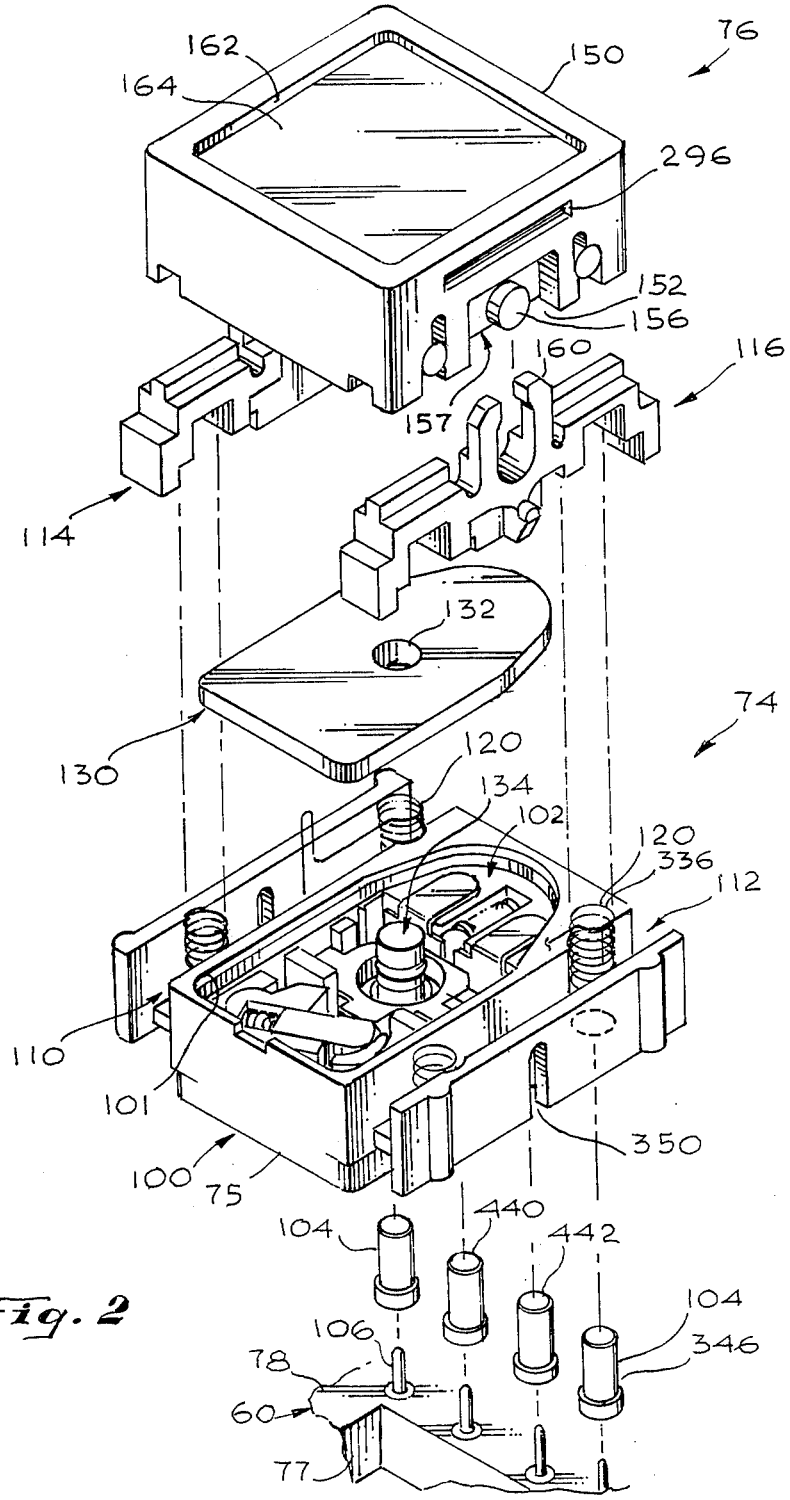
FIG. 2 is an exploded isometric view of the switch module of FIGS. 1A and 1B depicting the lamp subassembly and switch subassembly thereof.

Attention is now directed to FIG. 2 which depicts an exploded view of the switch module 50. The switch subassembly 74 is basically comprised of a switch housing 100 defining an internal cavity 101 which accommodates the components of a switch and tactile feedback mechanism, generally designated as 102. Four female connectors 104 are preferably press fit into openings in the housing 100 for receiving and making electrical connection to conductive pins 106 soldered and/or staked to the upper surface 78 of aforementioned circuit board 60. The housing 100 defines a pair of guide channels 110 and 112 to respectively accommodate first and second mounting retainers 114, 116. The mounting retainers 114, 116 are supported within the guide channels 110, 112 on springs 120 enabling the retainers 114, 116 to move reciprocally in a direction perpendicular to the nominal plane of the housing 100.

A cover plate 130 is provided to fit over the housing cavity to cover the switch and tactile feedback mechanism 102. The cover plate 130 has an opening 132 for accommodating the upper end of a plunger 134. The plunger 134, as will be discussed hereinafter, forms part of the actuator of the switch and tactile feedback mechanism 102.

The lamp subassembly 76 includes a substantially rectangular frame 150 having a first sidewall defining an opening 152. A retainer pin 156 extends outwardly from the first sidewall of a housing 157 fitted within the frame 150. The retainer pin 156 is intended to be detachably received within the jaws of a retainer clip 160 formed on the upper edge of mounting retainer 116. The second sidewalls of the frame 150 and housing 157 (hidden in FIG. 2) are identical to the illustrated first sidewalls and thus include a retainer pin for coupling to a retainer clip on mounting retainer 114.

The lamp subassembly frame 150 defines a rectangular window 162 closed by a translucent chip 164. The chip 164 can bear suitable indicia to identify the function of the related switch subassembly, e.g. HEATER. As will be discussed hereinafter, the lamp subassembly 76 includes an energizable light source, e.g. incandescent bulb, mounted within the housing 157 beneath the window 162 to back light the translucent chip 164.

When the switch module 50 is functionally mounted, as depicted in FIG. 1B, a lamp subassembly 76 in the quiescent position can be manually depressed (arrow 79) to in turn depress the aforementioned plunger 134 to actuate the switch and tactile feedback mechanism 102. Manual depression of the lamp subassembly 76 compresses the springs 120, which, when the depressing force is removed, return the lamp subassembly 76 to its quiescent state when the depressing force is removed. As mentioned, in addition to functioning as the push button actuator for the switch subassembly 74, the lamp subassembly 76 includes a light source for back lighting the translucent chip 164. As will be discussed hereinafter, electrical power for the light source within the lamp subassembly 76 is coupled thereto from the circuit board 60 via two of the aforementioned female connectors 104 and through two of the springs 120. That is, when the lamp subassembly 76 is properly retained on the mounting retainers 114, 116, contact pads on the lamp subassembly 76 (not shown in FIG. 2) electrically contact portions of the springs 120 to complete an electrical path to energize the light source within lamp subassembly 76.

Figure 3:
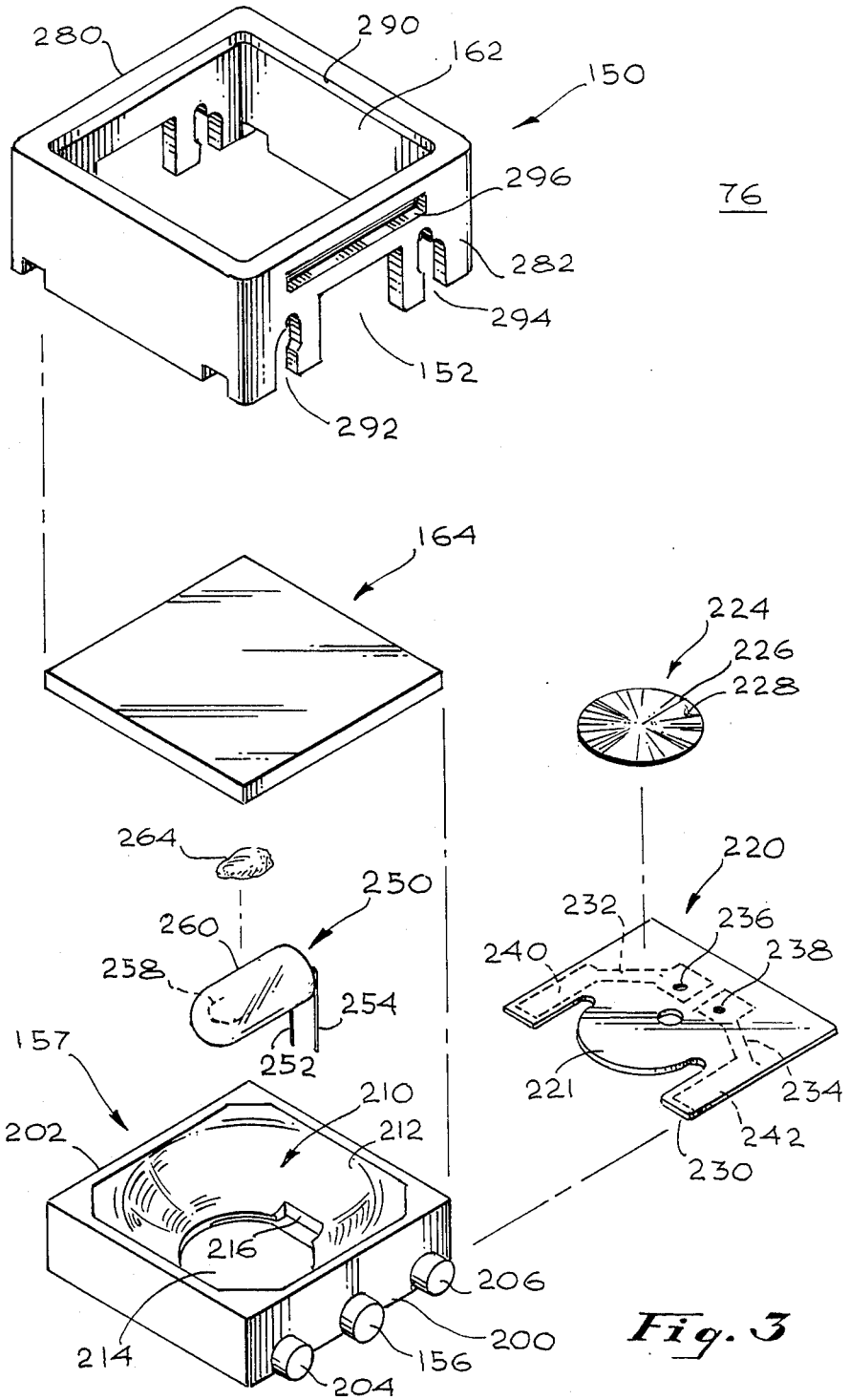
FIG. 3 is an exploded isometric view of the lamp subassembly of FIG. 2.
Figure 4:
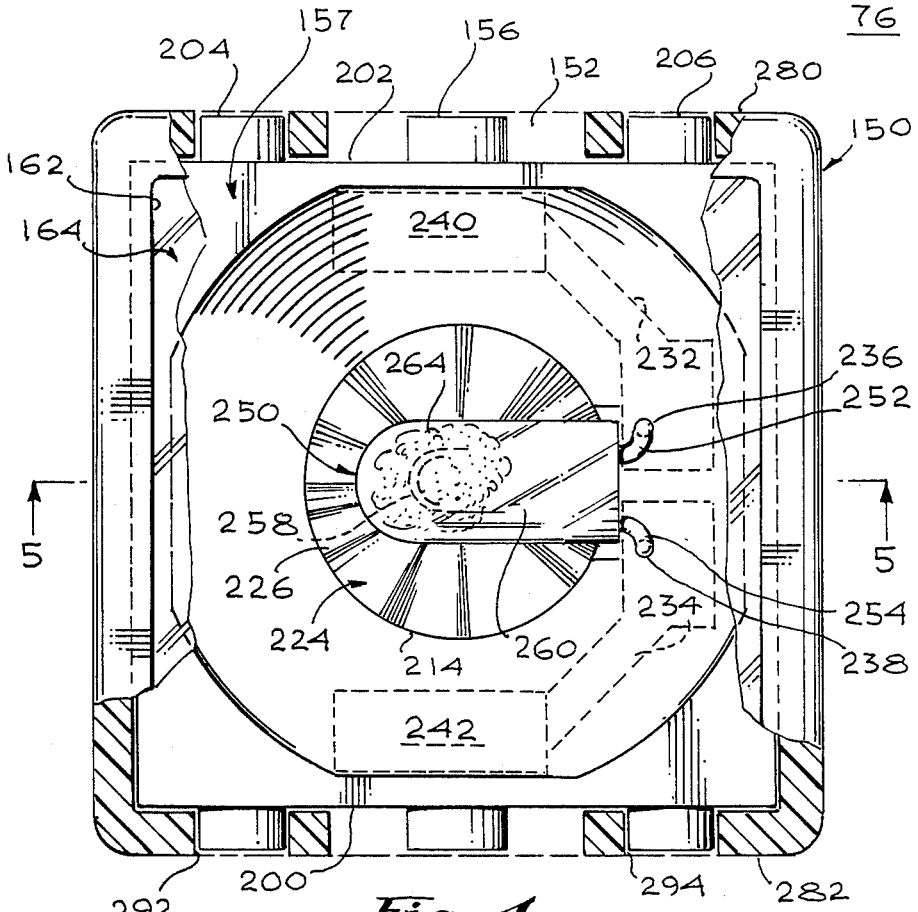
FIG. 4 is a plan view of the lamp subassembly.
Figure 5:
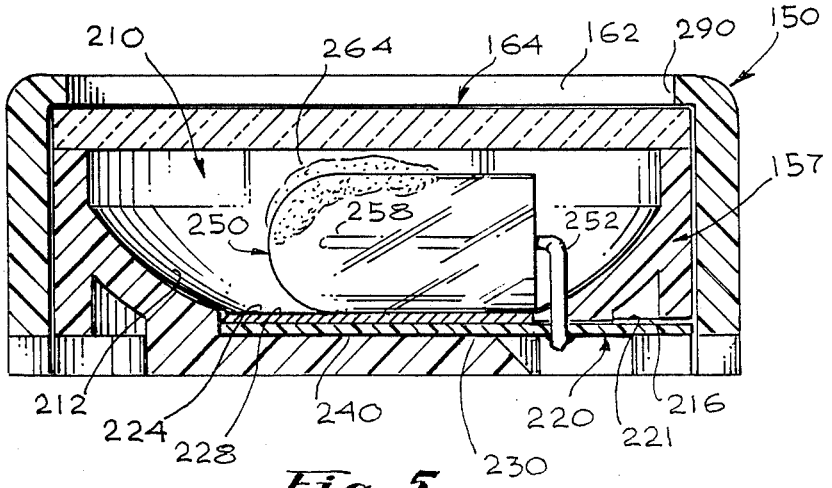
FIG. 5 is a sectional view taken substantially along the plane 5—5 of FIG. 4.

Attention is now directed to FIGS. 3–5 which illustrate the constructional details of the preferred lamp subassembly 76. The subassembly is comprised of the aforementioned housing 157 which is substantially rectangular in shape and includes first and second sidewalls 200 and 202. In addition to the aforementioned retainer pin 156, pins 204 and 206 extend from each of the sidewalls. As will be seen hereinafter, whereas retainer pins 156 function to detachably retain the lamp subassembly 76 to the switch subassembly 74, the pins 204 and 206 function to retain the lamp housing 157 to the lamp housing frame 150.

The housing 157 defines an open internal cavity 210. The interior surface 212 of the cavity, in vertical cross section (FIG. 5), is substantially parabola shaped, truncated by a central circular opening 214. In addition, a small lead access opening 216 is formed in the interior surface 212 in close proximity to the opening 214.

The lamp subassembly 76 further includes a circuit board 220 adapted to be mounted immediately beneath the lamp housing 157, as depicted in FIG. 5. More particularly, the circuit board 220 is supported beneath housing 157 to close the aforementioned central circular opening 214 and to support a flat disk 224 thereon. In accordance with a significant feature of the invention, the disk 224 has a plurality of very fine grooves 226 formed on the upper surface 228 thereof. The grooves, preferably in a radiating spoke pattern, form a circular diffraction grating. The upper surface 228 of disk 224, as well as the parabola shaped interior surface 212, is preferably metalized in a manner to enhance uniform reflectivity, as will be further discussed hereinafter.

The disk 224 is supported on the upper surface 221 of circuit board 200. The circuit boards lower surface 230 defines first and second conductive paths 232, 234 extending from lead openings 236, 238 to contact pad areas 240, 242. As will be seen hereinafter, when the lamp subassembly 76 is operationally mounted together with the switch subassembly 74, the contact pads 240, 242 are automatically engaged by spring contacts to electrically connect the pads to the outer connectors 104 depicted in FIG. 2.

Continuing with the detailed description of the lamp subassembly 76 of FIGS. 3–5, an energizable light source is provided, preferably an incandescent bulb 250 having first and second leads 252 and 254. The leads 252 and 254 are insertable through the access opening 216 and into the circuit board openings 236 and 238 for connection to the conductive paths 232, 234. It is preferable to mount the bulb 250 to the circuit board 220 so that the bulb filament 258 lies in a plane extending substantially parallel to the plane of the diffraction grating disk 224. In this manner, the illumination from the bulb is optimally distributed over the reflective surface formed by the cavity interior surface 212 and diffraction grating surface 228. By optimally distributing the bulb illumination over the entire reflective surface, a more uniform light intensity is produced to back light the translucent chip 164. Additionally, in order to acheive uniform intensity and minimize shadows, it is preferable that the bulb 250 have a clear glass envelope 260 and that the bulb leads 252, 254 exit directly through the access opening 216. Still further, in order to enhance the uniformity of the light reflected through chip 164 and to avoid the appearance of a bright spot directly from the filament 258, it is desirable to deposit a small amount of translucent diffuser material 264 on the glass envelope 260 immediately above the filament 258.

The aforementioned translucent chip 164 preferably comprises a substantially rigid piece of diffuser material, either clear or colored. Indicating indicia can be provided on the chip 164 by screening opaque characters or symbols thereon. With the chip 164 overlaying the housing cavity 210, light from the bulb 250 will be efficiently reflected from the diffraction grating surface 228 and interior surface 212 through the chip 164. By optimally orienting the bulb filament 258 and utilizing the diffuser material 264, a substantially uniform relatively high intensity light field will be reflected over the entire chip area. The utilization of the diffraction grating disk 224, in conjunction with the truncated parabolic surface 212, forms a very low profile, short depth, reflector which very efficiently transmits the illumination from bulb 250 through the chip 164.

The lamp subassembly 76 is held together by the aforementioned lamp housing frame 150. The frame 150 comprises an essentially open rectangular structure including sidewalls 280, 282 and an overhanging upper lip 290 surrounding the aforementioned window 162. The side walls 280, 282 are identically formed and, and as can best be seen in FIG. 3, include the aforementioned opening 152 and first and second pin slots 292, 294. The pin slots 292 and 294 function to slideably receive and accommodate the aforementioned pins 204, 206 extending from the side walls of housing 157. The frame 150, as well as the housing 157, preferably comprise closely dimensioned molded plastic parts such that the frame 150 can be manually pressed down on the housing 157 to seat the pins 204, 206 in the frame slots 292, 294 to form an integrated substantially tight package.

Fingernail grooves 296 are preferably formed in the outer surfaces of side walls 280, 282 of frame 150. The fingernail grooves extend above the front plate 70, as depicted in FIG. 1B, enabling the frame 150 to be grasped by a user from the front of the plate 70. As will be seen hereinafter, by pulling the lamp housing frame 150, utilizing the fingernail grooves 296, a user can detach the entire lamp subassembly 76 from the switch subassembly mounting retainers 114, 116. Additionally, the fingernail grooves 296 facilitate the detachment of the frame 150 from the lamp housing 157. That is, by grasping the frame 150 with the fingernails of one hand in the grooves 296, a user can utilize the fingers of his other hand to pull on the retainer pins 156. In this way, the user can lift frame 150 off housing 157 to expose the cavity 210 and thereby provide access to bulb 250 enabling it to be readily replaced.

Figure 6:
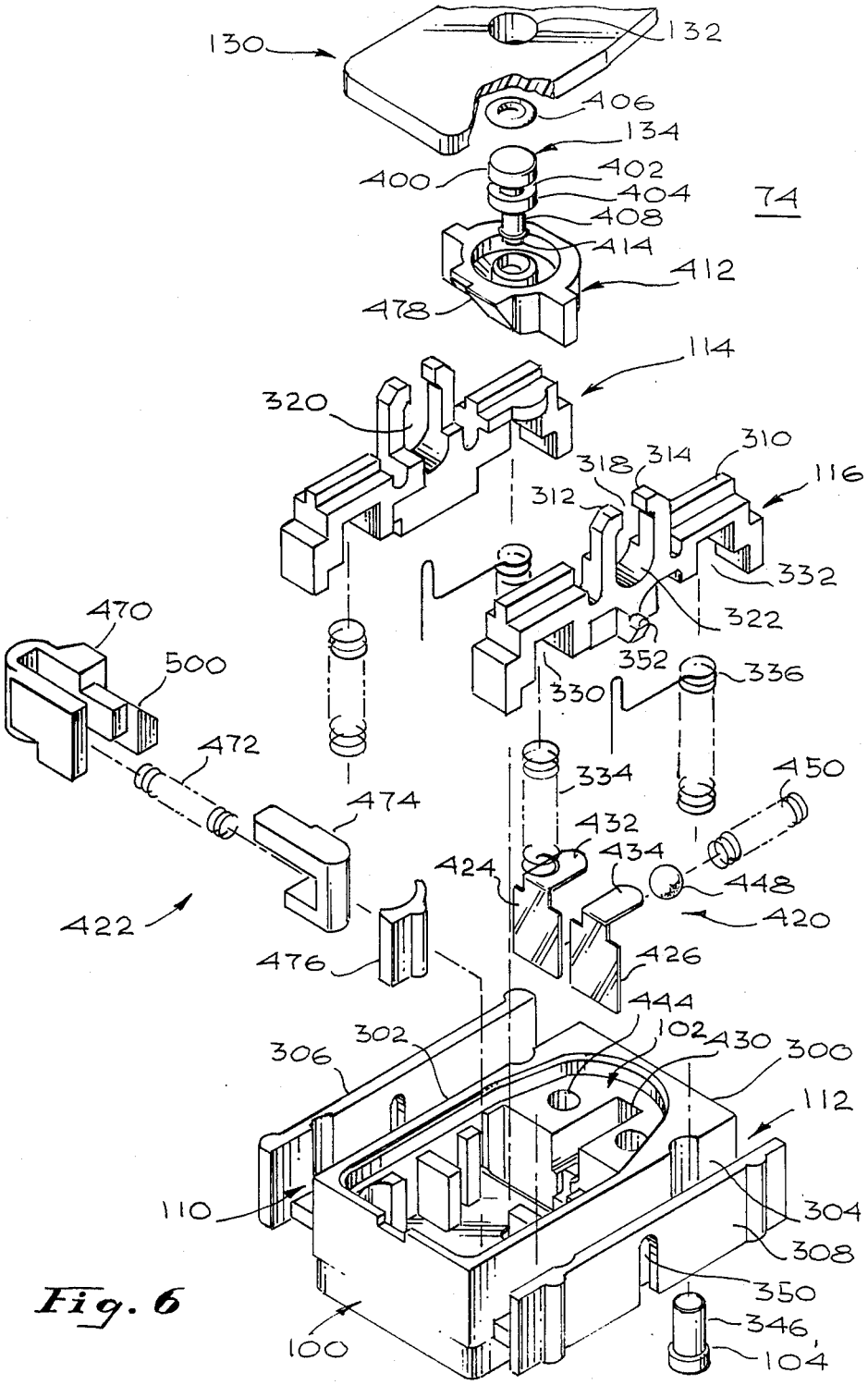
FIG. 6 is an exploded isometric view of the switch subassembly of FIG. 2.
Figure 7:
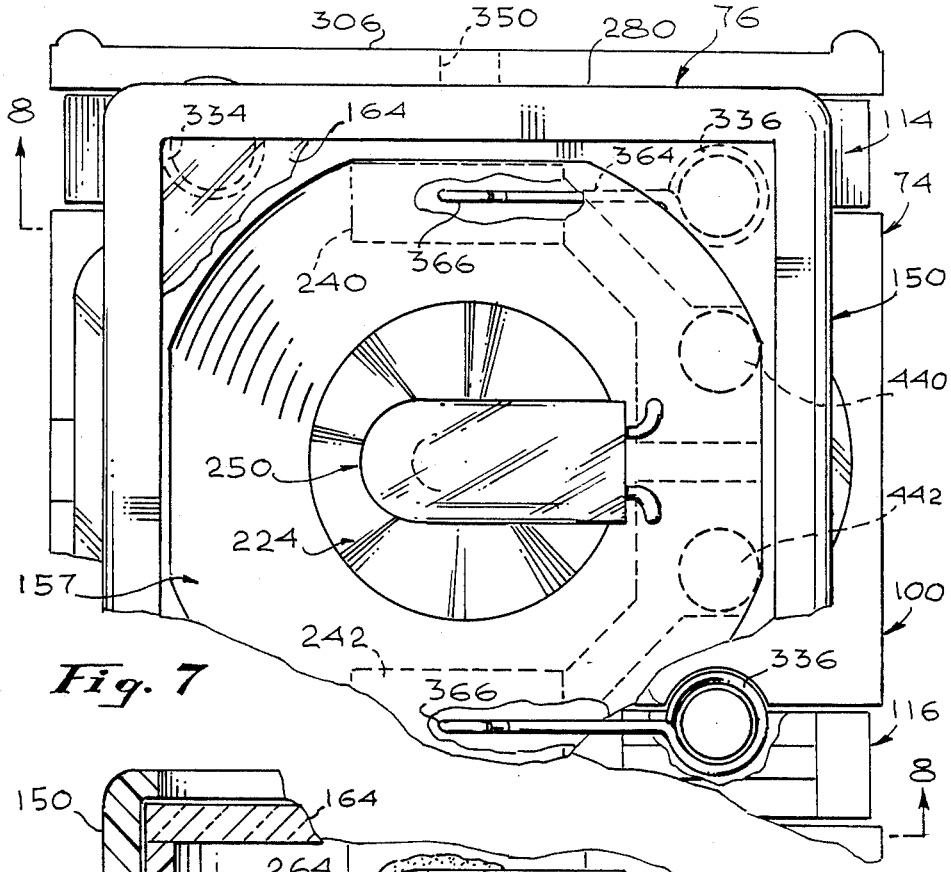
FIG. 7 is a plan view generally depicting the mechanical and electrical interface between the lamp and switch subassemblies.

Attention is now directed primarily to FIG. 6 which illustrates an exploded view of the switch subassembly 74. The switch subassembly includes the aforementioned switch housing 100 which is substantially planar in form and rectangular in shape. The housing 100 is essentially comprised of a center section 300 which contains the aforementioned internal cavity 101 for accommodating the aforementioned switch and tactile feedback mechanism 102. The section 300 includes first and second side walls 302 and 304. Outer walls 306 and 308 are respectively spaced from the side walls 302 and 304 to respectively define therebetween the aforementioned guide channels 110, 112 for accommodating the mounting retainers 114, 116.

The mounting retainers 114 and 116 are mirror images of one another and each is configured to fit within one of the guide channels 110, 112 for sliding movement therein. More particularly, each of the mounting retainers 114, 116 comprises an elongated member having an upper surface 310 having a pair of closely spaced opposed jaws 312, 314 extending therefrom. The mounting retainers 114, 116 preferably comprise molded plastic parts of appropriate material to enable the extending jaws 312 and 314 to flex resiliently outward slightly to enable the aforementioned retainer pins 156 to press past the inwardly extending opposed jaw ends 318.

Figure 8:
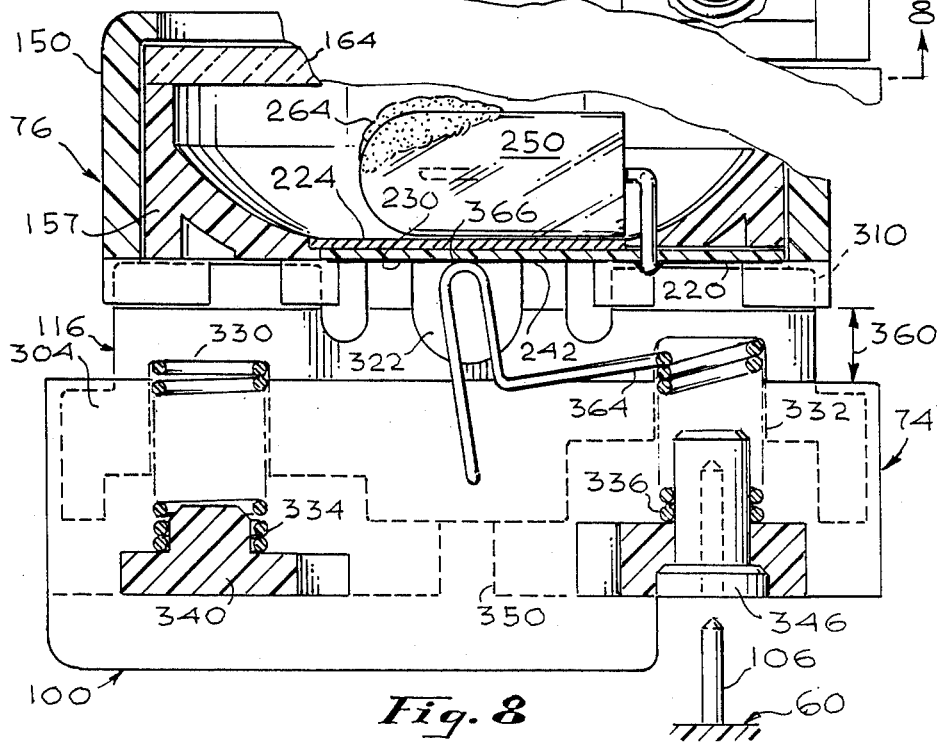
FIG. 8 is a sectional view taken substantially along the plane 8—8 of FIG. 7.

Each mounting retainer 114, 116 also includes first and second recesses 330 and 332 for respectively accommodating the upper ends of coil springs 334 and 336. The lower end of coil spring 334 fits over and is retained on stud 340 formed in the floor of a guide channel 110, 112, as is best depicted in FIG. 8. The lower end of coil spring 336 fits around and is electrically coupled to female connector 346, as is also best illustrated by FIG. 8. Connector 346 comprises one of the female end connectors 104 previously mentioned in the description of FIG. 2. Connector 346 physically accommodates and is electrically connected to one of the conductive pins 106 affixed to the aforementioned circuit board 60.

Outer walls 306, 308 define a tab slot 350 for receiving a tab 352 formed along the outer edge of each mounting retainer 114, 116. When properly assembled, the mounting retainers 114, 116 are respectively accommodated in guide channel 110, 112 with the tabs 352 extending outwardly through the slots 350 and with the retainers supported on springs 334 and 336. Thus, the retainers 114, 116 are able to exhibit limited resilient and reciprocal movement within the channels in the direction represented by arrows 360 in FIG. 8.

In accordance with a significant feature of the invention, in order to complete the electrical path to bulb 250, each spring 336 is formed, as depicted in FIG. 8, with a cantilevered arm 364 extending from its upper coil. More particularly, the arm 364 is preferably integrally formed with the end coil of the spring 336 and terminates in a U-shaped contact 366 positioned to engage one of the contact pads 240, 242 on the under side of the lamp assembly circuit board 220. When the lamp subassembly is properly mounted on the retainers 114, 116 with each pin 156 seated on an arcuate surface 322, each contact pad, e.g. 242 will engage the U-shaped terminal contact 366 of a cantilevered spring arm 364. The arm 364 is essentially rigid such that it primarily flexes around a line through the axis of coil spring 336. In this manner, the terminal contact 366 and contact pad 242 form a good low resistance nonwearing contact interface which, nevertheless, permits easy detachment and replacement of the lamp subassembly 76.

Figure 10:
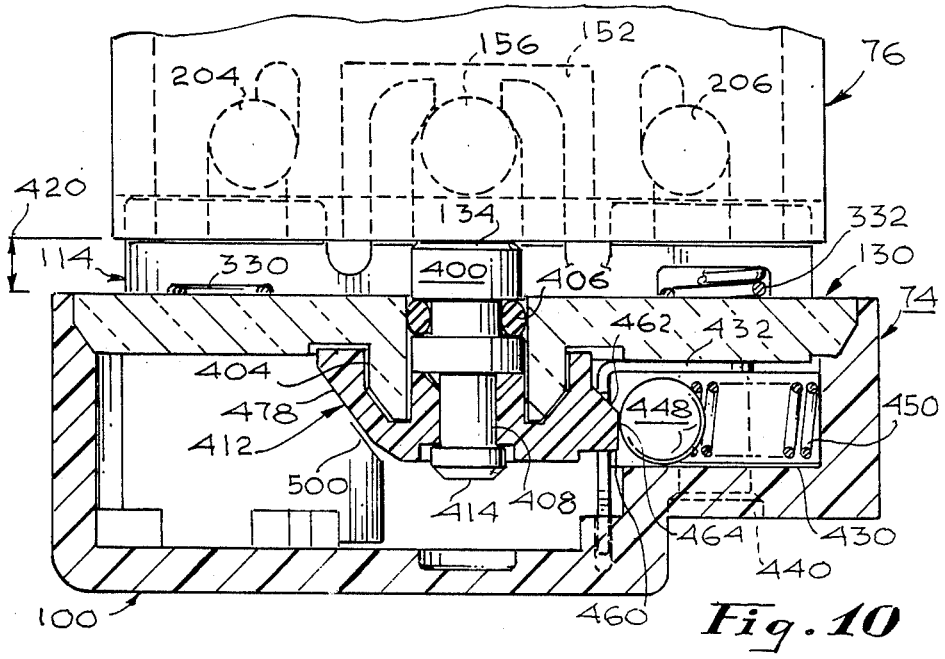
FIG. 10 is a sectional view taken substantially along the plane 10—10 of FIG. 9 showing the actuator in its quiescent undepressed position.

When the lamp subassembly 76 is properly mounted in the mounting retainers 114, 116, the bottom surface 230 of the circuit board 220 engages the aforementioned plunger 134 of the switch subassembly 74. Plunger 134 is mounted for reciprocal movement within the central opening 132 of the cover plate 130. The plunger 134 preferably comprises an integral device having an upper portion including a head 400 and a flange 402 spaced therefrom. The head 400 extends above cover plate 130 and flange 402 is supported within opening 132 extending into boss 404 depending from the cover plate 130 (FIG. 10). An O-ring 406 is carried between the head 400 and flange 402 to seal opening 132.

Figure 12:
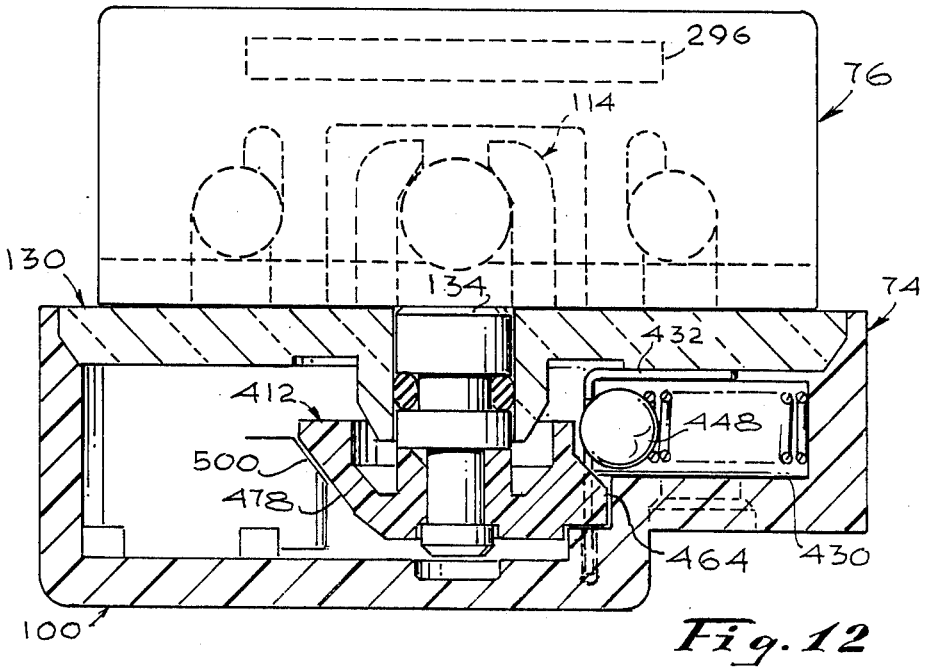
FIG. 12 is a sectional view taken substantially along the plane 12—12 of FIG. 11 showing the actuator in its depressed position.

The lower portion of the plunger 134 includes a shaft 408 which extends through a central opening of an actuator member 412. The shaft 408 is secured to actuator member 412 as by lock washer 414. Thus, plunger 134 and actuator member 412 are essentially locked together so that finger pressure applied to the lamp subassembly 76 translucent chip 164 displaces plunger 134 and actuator member 412, i.e. as depicted by arrows 420 in FIG. 10. FIG. 10 depicts the actuator member 412 in its quiescent upper position. FIG. 12 depicts the actuator member 412 in its depressed lower position. As will be seen hereinafter, the actuator member 412 controls a switching mechanism such that the switch is normally open when the actuator member 412 is in its quiescent position (FIG. 10) and is closed when the actuator member 412 is in its depressed position (FIG. 12).

Figure 9:
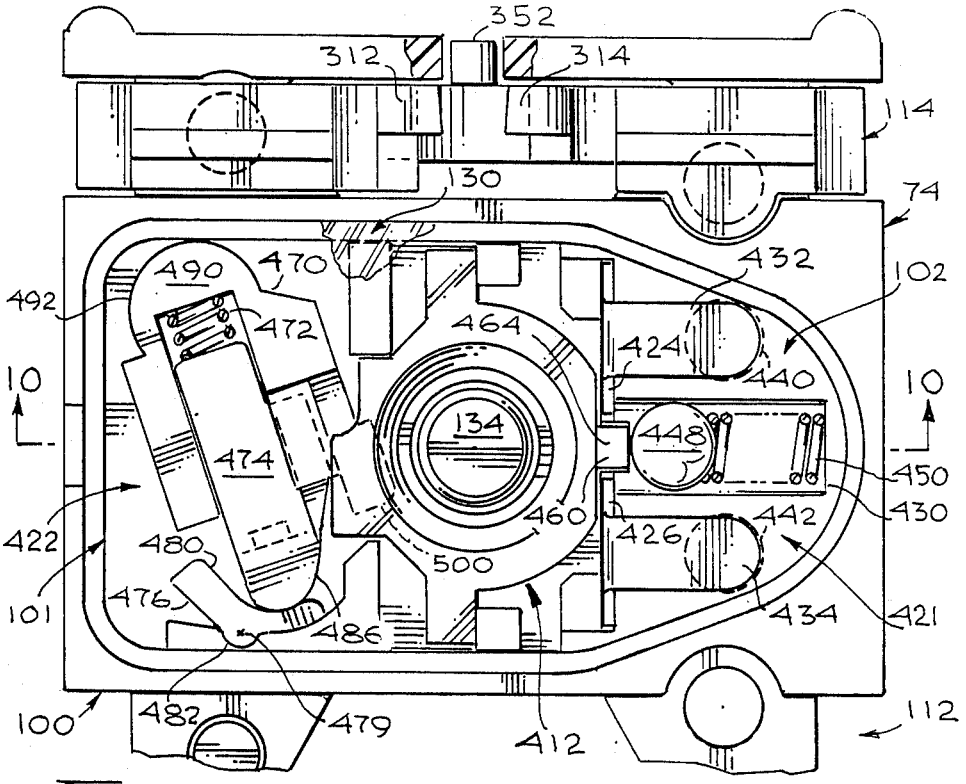
FIG. 9 is a plan view of the switch subassembly in its normally open state.

The aforementioned switch and tactile feedback mechanism 102 is comprised of two portions; namely, a switch portion 421 and a tactile feedback portion 422 (FIG. 9). The switch portion 421 includes switch contacts 424, 426 which are mounted within the housing recess 101 so that they are aligned with and overlay a guide groove 430. The switch contacts 424, 426 include terminal portions 432, 434 which connect electrically to female connectors 440, 442, i.e. the two central connectors of previously referred to connectors 104 in FIG. 2. Connectors 440, 442 are mounted with connector positioning holes 444 in housing 100.

The switch portion 420 further includes an electrically conductive member 448, preferably a gold plated ball, mounted for linear displacement with the guide groove 430 under the urging of a coil spring 450. In the absence of any interference, the spring 450 urges the ball 448 into engagement with the contact 424, 426 to thus electrically connect connectors 440 and 442.

The actuator member 412 is shaped so that when in its quiescent position (FIG. 10) it interferes with the ball 448 and blocks it from electrically bridging contacts 424, 426. When depressed, the actuator member moves out of the way to permit the spring 450 to displace the ball 448 into engagement with the contacts 424, 426. More particularly, the actuator member 412 includes a radially extending projection 460 including a ramp portion 462 and end portion 464. Note in FIG. 10 that the end portion 464 of the projection 460 extends through the gap between the spaced contacts 424, 426 to engage the ball 448 to block it from engaging contacts 424, 426. When the actuator member 412 is depressed, as depicted in FIG. 12, the projection end 464 moves out of interfering relationship to thereby permit the ball to move into bridging contact against contacts 424, 426. The utilization of a conductive ball 448 mounted for linear displacement in the manner depicted in the drawings for selectively bridging contacts 424, 426 assures a low resistance, high reliability and easily fabricated switch mechanism.

Figure 11:
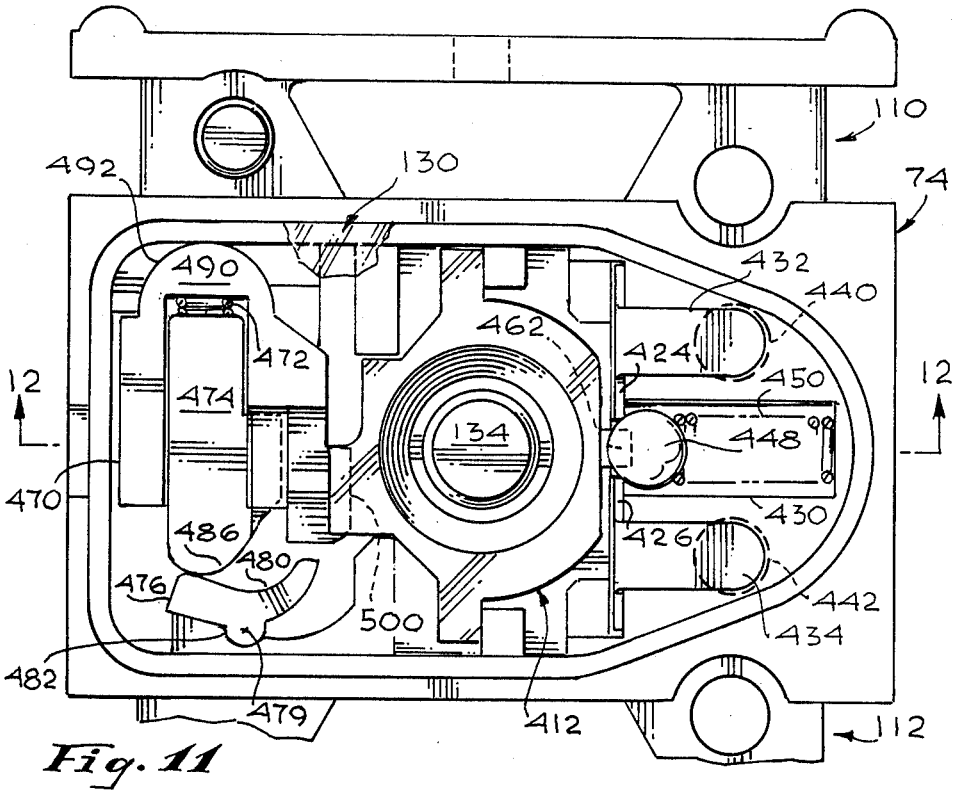
FIG. 11 is a plan view of the switch subassembly in its closed state.

The tactile feedback portion 422 functions to develop a reaction force to indicate to a user when switch closure has occurred. More particularly, as a user depresses the lamp subassembly 76 toward switch closure, it is desirable for the user to experience a reaction force which increases as the actuator is displaced toward the toggle point and then abruptly diminishes as the switch is closed to thus provide a "snap" feel. This tactile feedback is provided in accordance with the preferred embodiment by elements 470, 472, 474, and 476 which cooperate with a wedge or inclined surface 478 formed on actuator member 412. More particularly, as is best depicted in FIGS. 9 and 11, element 476 comprises a rocker arm including a rolling pivot portion 479 and an upper surface 480. By applying an appropriate downward force (e.g. in the plane of FIG. 9) against the surface 480, the rocker 476 can be caused to rock around the rolling pivot 479, mounted for rolling movement in recess 482 in the housing 100. This force is supplied against the surface 480 by a pusher member or plunger 474 having a lower surface 486 which bears against the surface 480 of rocker arm 476 for sliding movement therealong. The plunger 474 is urged against the rocker surface 480 by spring 472 which is held captive between plunger 474 and toggle arm 470. Toggle arm 470 is shaped to define a rolling pivot 490 which is accommodated in a mating recess 492 in housing 100. Toggle arm 470 is provided with an inclined surface 500 mounted for engagement against inclined surface 478 of actuator member 412.

When the actuator member 412 is in the quiescent position depicted in FIG. 10, the toggle arm 470 will be in its quiescent position established by the spring 472 bearing against plunger 474 to force the rocker arm 476 to its clockwise position as depicted in FIG. 9. As the lamp subassembly 76 is depressed to displace the actuator member 412 toward its actuated position depicted in FIG. 12, the actuator member inclined surface 478 bears against the inclined surface 500 of the toggle arm to rotate it about its rolling pivot 490 within recess 492. This, of course, slides plunger surface 486 along surface 480 of rocker arm 476. As the surface 486 moves toward a threshold or center position essentially defined by a straight line projected between the axes of rolling pivots 479 and 490, the compression of spring 472, increases thereby providing an increasing reaction force, via the actuating member 412 to the user pressing the lamp subassembly 76. However, once the surface 486 of plunger 474 moves past the center position, the rocker arm 480 is toggled to its counter clockwise position (FIG. 11) thereby enabling the spring 472 to expand and abruptly diminish the reaction force felt by the user.

When the user releases the lamp subassembly 76, the springs 334, 336 will lift the mounting retainers 114, 116 thus relieving the downward force on actuator member 412. The spring 472, still under compression in the position depicted in FIG. 11, will want to expand and thus will slide surface 486 along rocker arm surface 480 as it pivots the toggle arm 470 clockwise toward the orientation of FIG. 9. As the toggle arm 470 returns to the orientation of FIG. 9, its inclined surface 500 will bear against inclined surface 478 to lift the actuator member 412 to its quiescent position with projection 460 bearing against ball 448 to open the switch.

From the foregoing, it should now be appreciated that an improved push button switch module has been described herein comprised essentially of a switch subassembly intended to be physically and electrically mounted on a circuit board and a lamp subassembly intended to be detachably mounted on the switch subassembly. A module in accordance with the invention can be accommodated in a very small package occupying, for example, only about a one quarter square inch area (½ inch square) on the circuit board. The full vertical or depth dimension of the module can also be accommodated in less than one half inch with the switch subassembly housing comprising about one half of that dimension. Thus, the circuit board 60 and cover plate 70 can be very closely spaced, i.e. within about one quarter inch of each other. Despite these small dimensions, the lamp subassembly configuration enables a single lamp to provide ample uniform back lighting of a translucent chip, as a consequence of the optimized reflector, and enables a user to readily replace the lamp from the front of the plate 70 using only his fingers. The switch subassembly configuration assures good tactile feedback and good low resistance low bounce switching within a low profile package.

Although a particular exemplary embodiment has been described and illustrated herein, it is recognized that numerous modifications and variations falling within the intended scope of the invention may readily occur to those skilled in the art. For example only, light sources other than incandescent bulbs, e.g. light emitting diodes, can be employed. As a further example, the cantilevered contact arms 364 for providing electrical connection to the movably mounted lamp subassembly can comprise separate elements rather than be integral with springs 336. As a still further example, the movable contact member 448 can be other than ball shaped and the tactile feedback mechanism 102 can utilize a linearly displaceable member rather than the pivotally mounted toggle arm 470. In view of the foregoing, it is intended that the appended claims be liberally interpreted to cover all reasonable modifications and variations.

I claim:

1. An illuminated push button switch module comprising:

a switch subassembly including a switch actuator mounted for limited reciprocal displacement;

a lamp subassembly including a translucent chip, at least one electrically energizable light source means fixedly mounted relative to said chip for backlighting said chip and at least one electrical contact pad connected to said light source means;

mounting means for supporting said lamp subassembly and for allowing resilient reciprocal displacement thereof toward and away from said switch subassembly for displacing said switch actuator in response to said lamp subassembly being displaced;

means attaching said lamp subassembly to said mounting means for permitting detachment without the use of tools; and electrical contact means carried by said switch subassembly for engaging said contact pad when said lamp subassembly is retained on said mounting means, said contact means comprising a contact terminally carried by a resiliently mounted cantilevered arm.

2. An illuminated push button switch module comprising:

a switch subassembly including a switch actuator mounted for limited reciprocal displacement;

a lamp subassembly including a translucent chip, at least one electrically energizable light source means fixedly mounted relative to said chip for backlighting said chip and at least one electrical contact pad connected to said light source means;

mounting means for supporting said lamp subassembly and for allowing resilient reciprocal displacement thereof toward and away from said switch subassembly for displacing said switch actuator in response to said lamp subassembly being displaced;

means attaching said lamp subassembly to said mounting means for permitting detachment without the use of tools;

electrical contact means carried by said switch subassembly for engaging said contact pad when said lamp subassembly is retained on said mounting means;

said switch subassembly and said lamp subassembly including substantially flat housings oriented parallel to one another;

said mounting means including spring means supporting said lamp subassembly housing for resilient displacement relative to said switch subassembly housing;

said spring means including at least one coil spring formed of electrically conductive material and having an axis oriented substantially perpendicular to said flat housings; and wherein said contact means includes a cantilevered arm extending from an end coil of said coil spring

3. The module of claim 2 including a circuit board; and means electrically connecting said switch subassembly to said circuit board.

4. The module of claim 3 wherein said switch subassembly has a larger perimeter than said lamp subassembly; and a plate having front and rear faces and an aperture therein large enough to pass said lamp subassembly therethrough; and means mounting said plate with said rear face bearing against said switch subassembly to clamp it against said circuit board.

5. The module of claim 3 wherein said means electrically connecting said switch subassembly to said circuit board includes: at least one male connector mounted on said circuit board; and further including female connector means carried by said switch subassembly for physically receiving said male connector therein.

6. The module of claim 5 wherein said switch subassembly has a larger perimeter than said lamp subassembly; and a plate having front and rear faces and an aperture therein large enough to pass said lamp subassembly therethrough; and means mounting said plate with said rear face bearing against said switch subassembly to clamp it against said circuit board.

7. An illuminated push button switch module comprising:

a switch subassembly including a switch actuator mounted for limited reciprocal displacement;

a lamp subassembly including a translucent chip, at least one electrically energizable light source means fixedly mounted relative to said chip for backlighting said chip and at least one electrical contact pad connected to said light source means;

mounting means for supporting said lamp subassembly and for allowing resilient reciprocal displacement thereof toward and away from said switch subassembly for displacing said switch actuator in response to said lamp subassembly being displaced;

means attaching said lamp subassembly to said mounting means for permitting detachment without the use of tools; and electrical contact means carried by said switch subassembly for engaging said contact pad when said lamp subassembly is retained on said mounting means;

said mounting means including a first retainer member; and spring means supporting said retainer member for reciprocal displacement relative to said switch subassembly.

8. The module of claim 7 wherein said means for releasably retaining said lamp subassembly includes:

a retainer pin fixedly mounted on said lamp subassembly; and detent means mounted on said retainer member for receiving and releasably retaining said retainer pin.

9. The module of claim 8 wherein said detent means comprises first and second spaced jaw members mounted for resilient movement relative to one another for receiving said retainer pin therebetween.

10. The module of claim 8 wherein said lamp subassembly includes a finger nail groove therein for enabling a user to pull the lamp subassembly away from the switch subassembly to release said retainer pin from said detent means.

11. The module of claim 7 further including:

guide wall means mounted on said switch subassembly for engaging said retainer member to guide said retainer member reciprocal displacement relative to said switch subassembly.

* * * * *